US009243863B1

(12) United States Patent
Coalson

(10) Patent No.: US 9,243,863 B1
(45) Date of Patent: Jan. 26, 2016

(54) WRIST STRAP CONNECTOR FOR ARCHERY BOWSTRING RELEASE

(71) Applicant: TruGlo, Inc., Richardson, TX (US)

(72) Inventor: Damon Coalson, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 39 days.

(21) Appl. No.: 13/915,744

(22) Filed: Jun. 12, 2013

(51) Int. Cl.
*F41B 5/18* (2006.01)
*F41B 5/14* (2006.01)

(52) U.S. Cl.
CPC ..... *F41B 5/148* (2013.01); *F41B 5/1469* (2013.01)

(58) Field of Classification Search
CPC ..... F41B 5/1469; F41B 5/148
USPC ..... 124/35.2
See application file for complete search history.

(56) References Cited

U.S. PATENT DOCUMENTS 1,349,569 A * 8/1920 Hart ..... A44B 17/0011 24/676
3,881,796 A * 5/1975 Saunders ..... 439/422
5,357,939 A 10/1994 Tentler et al.
5,595,167 A 1/1997 Scott
5,615,662 A 4/1997 Tentler et al.
5,653,214 A * 8/1997 Lynn ..... F41B 5/1469 124/35.2
5,765,536 A 6/1998 Scott
5,857,452 A 1/1999 Troncoso
2006/0174861 A1* 8/2006 Ewing ..... F41B 5/1461 124/86
2006/0213304 A1* 9/2006 Takikawa ..... F16H 59/10 74/473.3
2008/0168970 A1* 7/2008 Tilby ..... F41B 5/1469 124/35.2

* cited by examiner

*Primary Examiner* — Gene Kim
*Assistant Examiner* — Jeffrey Vanderveen
(74) *Attorney, Agent, or Firm* — Alvin R. Wirthlin

(57) ABSTRACT

A wrist strap for connection to a plurality of different bowstring release mechanisms via a plurality of different connecting members, includes a flexible base member adapted to fit around the wrist of a user and a mounting assembly connected to the wrist strap. The flexible base member has first and second arms that converge towards an apex area. The mounting assembly is connected to the apex area and is adapted to receive and retain the plurality of different connecting members. The mounting assembly includes a lower mounting portion having a first feature for retaining at least a first of the plurality of extension members and a second feature for retaining a second of the plurality of extension members. The upper and lower mounting portions cooperate to releasably lock one of the extension members in one of two locking positions.

11 Claims, 7 Drawing Sheets

WRIST STRAP CONNECTOR FOR ARCHERY BOWSTRING RELEASE

CROSS-REFERENCE TO RELATED APPLICATIONS

This application is related to U.S. patent application Ser. No. 13/734,720 filed on Jan. 4, 2013, the disclosure of which is hereby incorporated by reference.

BACKGROUND OF THE INVENTION

This invention relates generally to archery equipment, and more particularly to a wrist strap adaptable to different connectors that may be associated with different bowstring release mechanisms, as well as a lockup for at least one of the release mechanisms when the mechanisms are not in use.

Many accessories for archery bows are available for facilitating bow handling, stabilizing the bow during use, improving aiming accuracy, and so on. One such accessory is in the form of a wrist strap with an attached bowstring release. Archery bowstrings of compound bows typically have pull forces on the order of about 40 to 90 pounds. The use of wrist straps has become common to accommodate these large forces which have the potential to cause possible injury to the archer's fingers. A wrist strap removes the force of the bowstring that would otherwise be present on the fingers and spreads the force over a relatively large surface area of the wrist and the back of the archer's hand while leaving at least the thumb or index finger of the hand free to activate the trigger mechanism of the bowstring release.

Since the hands and wrists of archers come in many different shapes and sizes, wrist straps and their accompanying string release mechanisms are typically adjustable to accommodate as many archers as possible. Various prior art solutions for connecting the bowstring release mechanism to the wrist strap have different connecting arrangements, and therefore are not interchangeable. It would be desirous to provide a wrist strap that is adaptable to various different connecting arrangements between the bowstring release mechanism and wrist strap.

In addition, when the bowstring release mechanisms are not in use, they often get in the way with other activities of the archer, such as handling the bow, loading an arrow, climbing a tree stand, as so on. It would therefore be desirous to provide a lockup device for the bowstring release mechanism to keep it out of the way when not in use.

SUMMARY OF THE INVENTION

In accordance with one aspect of the invention, a wrist strap for connection to a plurality of different bowstring release mechanisms via a plurality of different extension members, includes a flexible base member adapted to fit around the wrist of a user and a mounting assembly connected to the wrist strap. The mounting assembly is connected to the base member and is adapted to receive and retain the plurality of different extension members. The mounting assembly includes a lower mounting portion having a first feature for retaining at least a first of the plurality of extension members and a second feature for retaining a second of the plurality of extension members.

In accordance with a further aspect of the invention, a mounting assembly for an archery wrist strap includes lower and upper mounting members. The lower mounting member has a lower plate for connection to the wrist strap, a circular opening extending through the lower plate, and at least one groove extending radially from the opening. The upper mounting member connects to the lower mounting member and includes an upper plate with a circular pocket in alignment with the circular opening of the lower plate. A bearing member is rotatably mounted in the opening and the pocket. The bearing member has a transverse bore for receiving a connecting shaft portion of an extension member operatively associated with a bowstring release mechanism. The at least one groove is adapted to receive the shaft portion to thereby releasably lock the shaft portion, and thus the bearing member, against rotational movement.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
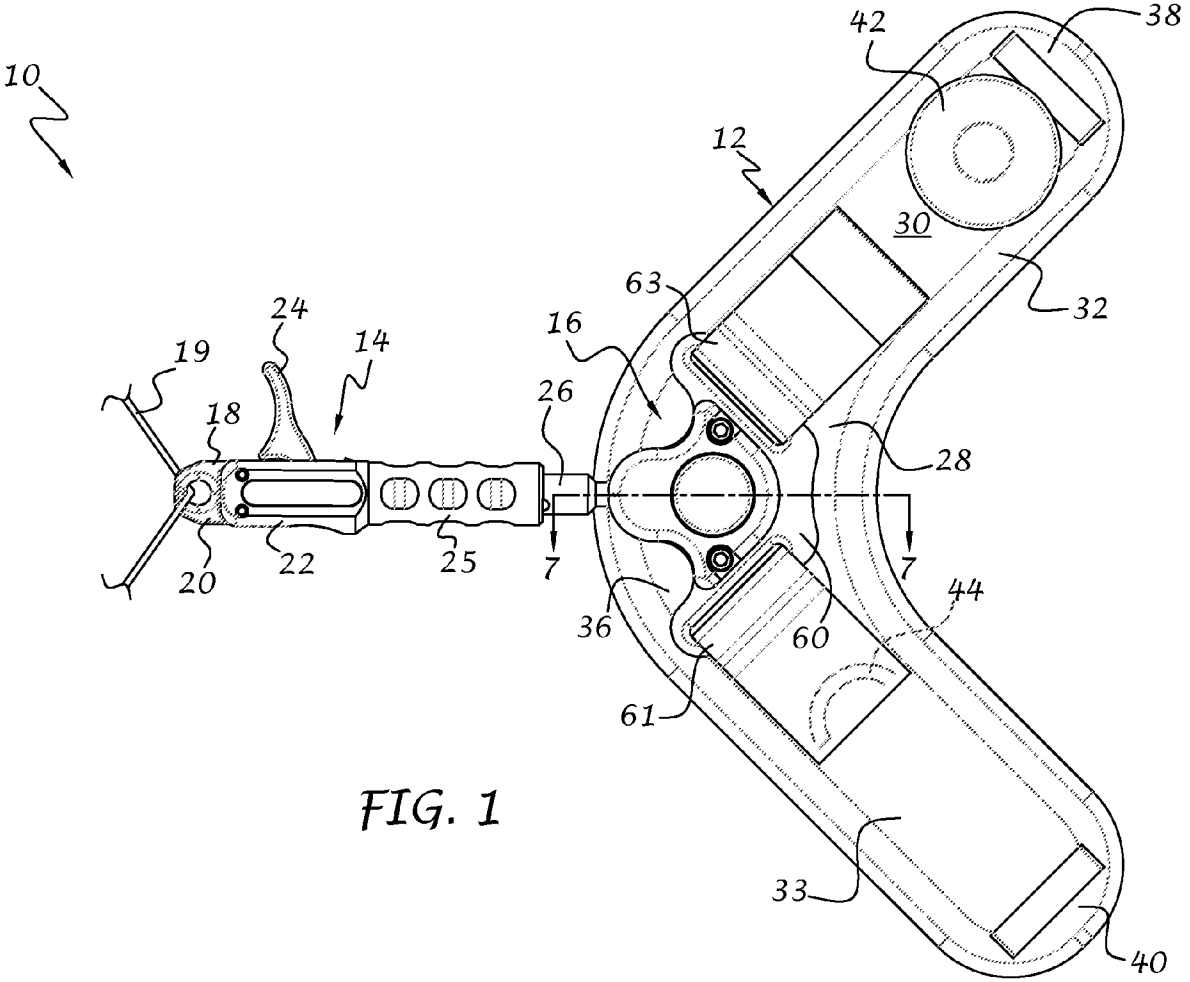
FIG. 1 is a top plan view of a bowstring release assembly with a bowstring release mechanism connected to a wrist strap in accordance with the present invention.

Referring now to the drawings, and to FIG. 1 in particular, a bowstring release assembly 10 in accordance with the invention is illustrated. The assembly 10 includes a bowstring release mechanism 14 removably connected to a wrist strap 12 via a mounting assembly 16 in accordance with the present invention. The bowstring release mechanism 14 extends from the wrist strap 12 for engaging a bowstring and/or a string loop or "D" loop 19 associated with the bowstring. The present invention is primarily adapted for use with compound bows due to the high pull forces that otherwise may injure the fingers of an archer, but may also be used with recurve bows, reflex bows, longbows, and so on.

The jaw mechanism 14 as shown includes a pair of jaws 18, 20 that extend outwardly from a body portion 22. A trigger 24 also extends from the body portion 22 and is operatively associated with one or both jaws such that, when the trigger 24 is pulled, movement of one or both jaws toward an open position occurs, to either release the bowstring or string loop when shooting, or allow entry of the bowstring or string loop into the center of the jaws when getting ready to assume a shooting stance. Likewise, pushing the trigger 24 in the opposite direction, either manually or automatically through a built-in biasing force, causes movement of one or both jaws from the open position toward the closed position to encircle or capture the bowstring or string loop 20. The internal components that permit operation of the jaw mechanism 14 in the above-described manner do not form part of the invention and therefore will not be further described. It will be understood that other jaw mechanisms and/or trigger devices can be used without departing from the spirit and scope of the invention.

A first extension member 26 is adjustably connected to the jaw mechanism 14 and rotationally connected to the mounting assembly 16. The extension member 26 is telescopically received in a rear portion 25 of the jaw mechanism 14 for adjusting a fixed distance between the trigger 24 and the mounting assembly 16 to accommodate different hand sizes and preferences of archers so that a proper shooting position can be achieved. It will be understood that other extension members can be used without departing from the spirit and scope of the invention.

Figure 7:
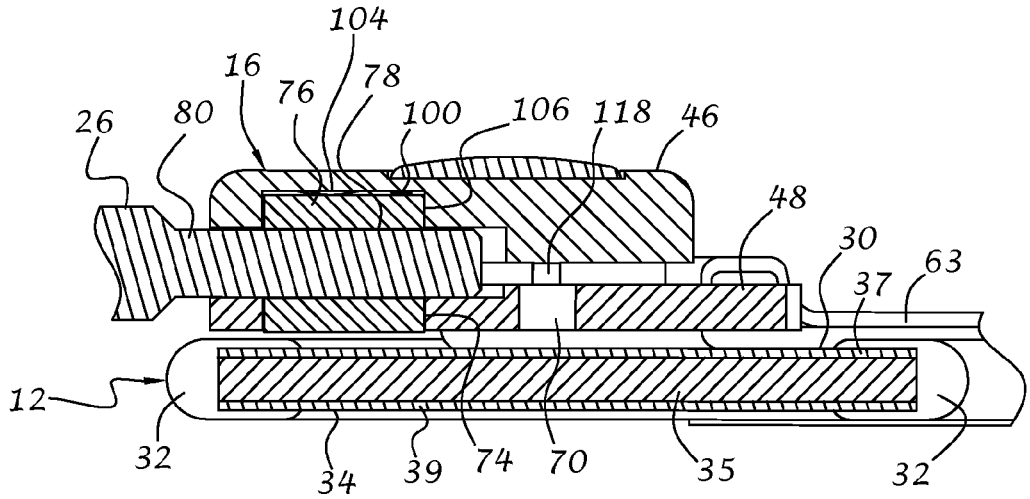
FIG. 7 is a sectional view of the bowstring release assembly taken along line 7-7 of FIG. 1.
Figure 8:
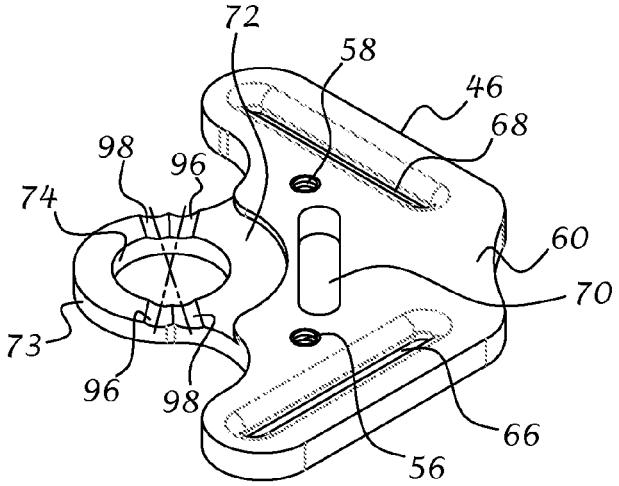
FIG. 8 is an isometric top view of the lower mounting portion in accordance with an exemplary embodiment of the invention.

An exemplary wrist strap 12 for use with the mounting assembly 16 of the present invention is illustrated in FIGS. 1 and 7. The wrist strap 12 includes a flexible base member 28 that is adapted to at least partially surround the wrist of an archer. As shown, the base member 28 is generally V-shaped when laid flat and includes a first arm 31 and a second arm 33 converging toward an apex portion 36. The base member 28 has a top surface 30 and bottom surface 34, a first end portion 38 associated with the first arm 31, and a second end portion 40 associated with the second arm 33, that diverge from the apex portion 36. It will be understood that the term "end portion" as used herein can include any portion of the flexible base member up to the apex portion. Preferably, the flexible base member 28 can be constructed of a center padding layer 35, an upper lining layer 37, and a lower lining layer 39 that are connected together via a continuous edging 32 that wraps around the periphery of the layers. The edging 32 can be connected to the layers by stitching or other any other means for connecting the layers together. It will be understood that the base member 28 can be constructed of a single layer of material or, alternatively, more than three layers of material, without departing from the spirit and scope of the invention.

An adjustment mechanism can be connected to the flexible base member 28 for cinching the wrist strap 12 around the wrist of a user with virtually infinite adjustment. The adjustment mechanism preferably includes a first anchor member 42 connected to the top surface 30 of the flexible base member 28 at or near the first end portion 38 of the base member, a second anchor member 44 (shown in hidden line) connected to the top surface 30 at or near the opposite second end portion 40 of the base member 28, and a cable (not shown) that extends between the first and second anchor members. The first anchor member 42 can be in the form of a reel assembly for winding and unwinding the cable while the second anchor member 44 serves to hold a loop of the cable during winding and unwinding. Further details of the wrist strap 12 are described in copending U.S. application Ser. No. 13/314,330 filed on Dec. 8, 2011, and assigned to TruGlo Inc., the disclosure of which is hereby incorporated by reference. It will be understood that the present invention is not limited to the particular wrist strap shown and described, as the mounting assembly of the present invention is adaptable to a wide variety of wrist strap types, styles, sizes, and adjusting mechanisms.

Figure 2:
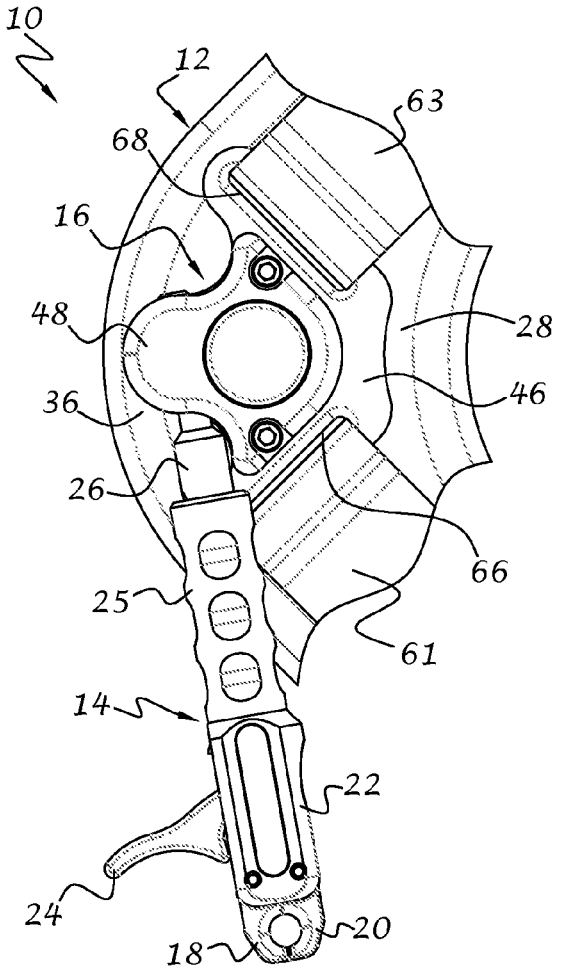
FIG. 2 is an enlarged top plan view of a portion of the bowstring release assembly showing a bowstring release mechanism in a first locked storage position.
Figure 3:
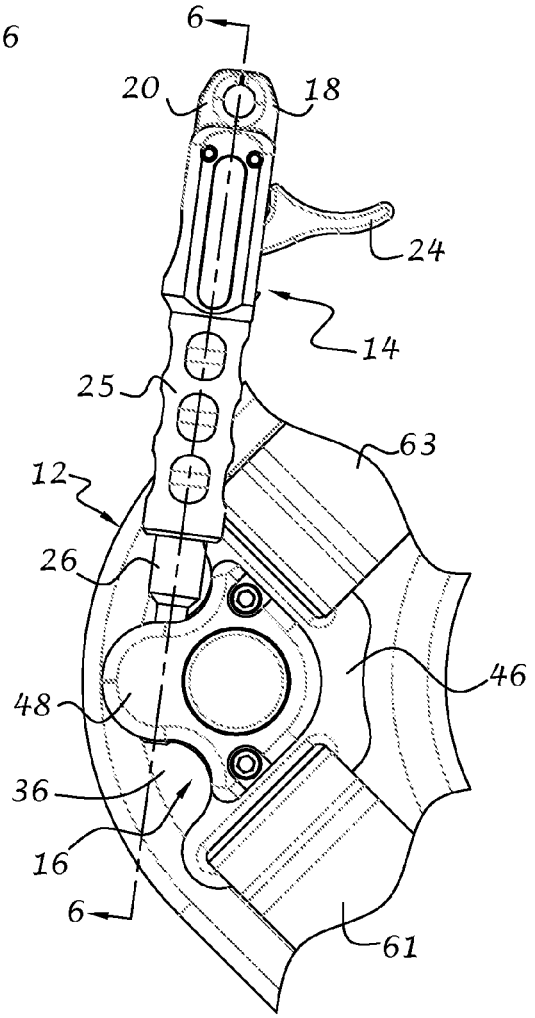
FIG. 3 is an enlarged top plan view of a portion of the bowstring release assembly showing the bowstring release mechanism in a second locked storage position.
Figure 4:
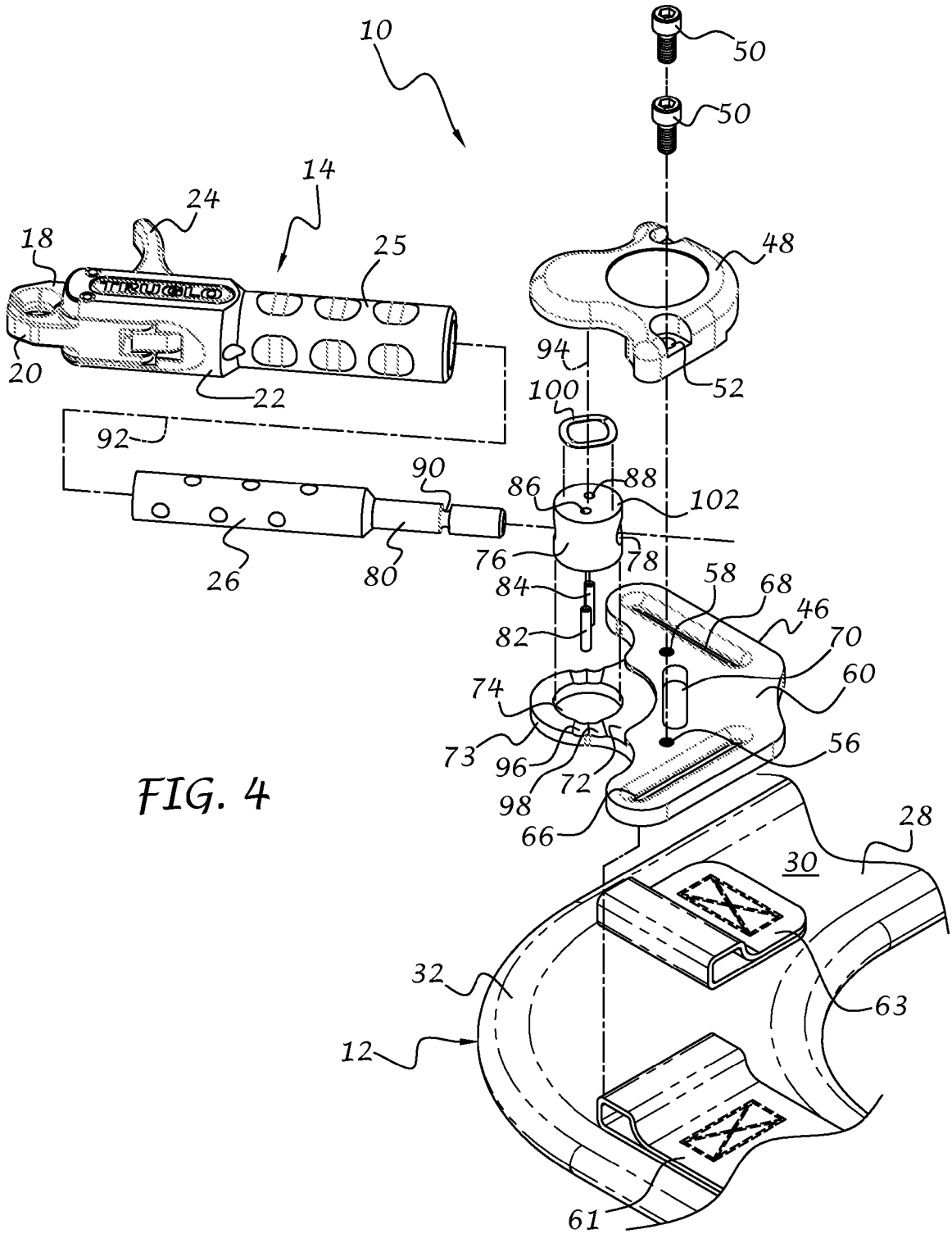
FIG. 4 is an exploded isometric view of a mounting assembly for connecting a first bowstring release mechanism to the wrist strap in accordance with the invention.
Figure 5:
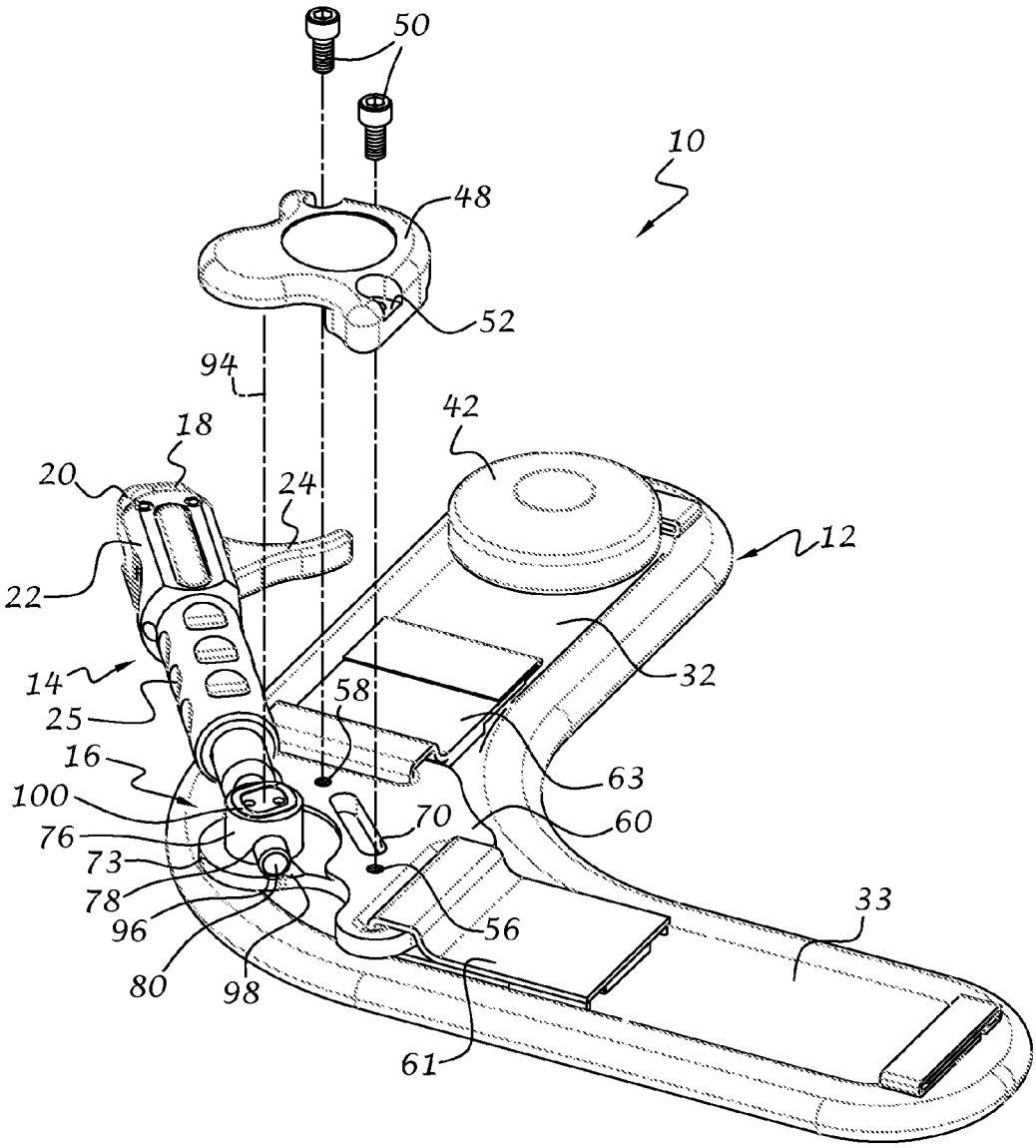
FIG. 5 is a partially exploded isometric view similar to FIG. 4 with the bowstring release mechanism connected to the wrist strap.
Figure 6:
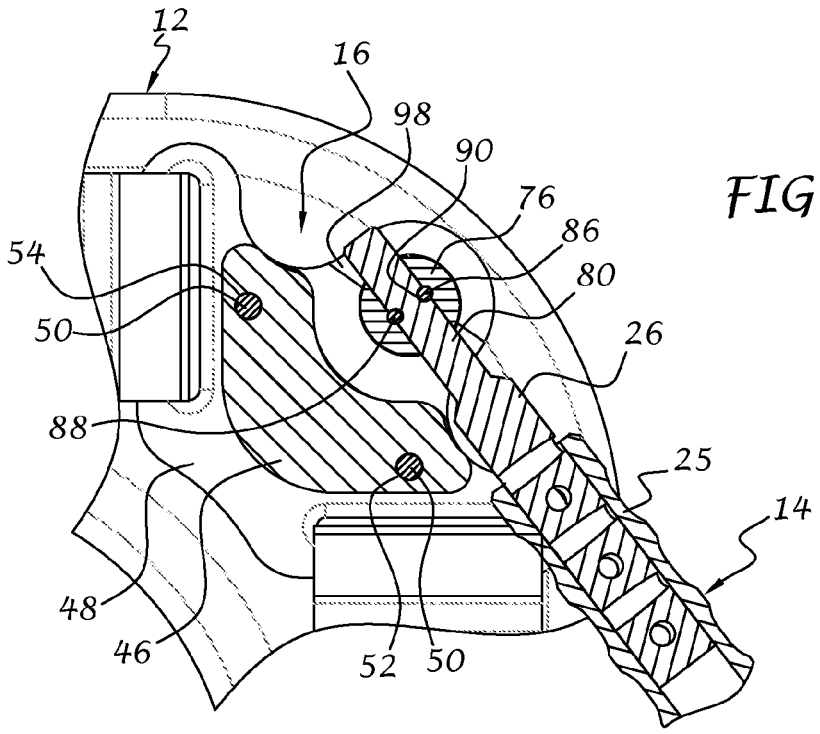
FIG. 6 is a sectional view a portion of the bowstring release assembly taken along line 6-6 of FIG. 3.

Referring now to FIGS. 2-3, the first bowstring release mechanism 14 can be removably secured at least in a first position, such as shown in FIG. 2, and preferably in both a first position (FIG. 2) and a second position (FIG. 3) when the release mechanism is not being used. This is especially convenient for archers who prefer to leave the wrist strap 12 wrapped around their wrist but wish to free their hands for tasks other than aiming or firing an archery bow. To that end, the first extension member 26 preferably releasably locks with the mounting assembly 16, as will be described in further detail below.

With additional reference to FIGS. 4-8, the mounting assembly 16 preferably includes a first lower mounting portion 46 connected to the wrist strap 12 and a second upper mounting portion 48 for connection to the lower mounting portion 46. As shown, a pair of fasteners 50, preferably in the form of threaded screws, extend through openings 52, 54 formed in the upper mounting portion 48 and thread into openings 56, 58 formed in the lower mounting portion 46.

The lower mounting portion 46 is preferably in the form of a generally triangular-shaped lower plate 60 and is attached to the top surface 30 of the base member 28 at the apex portion 36 thereof via a pair of bands or straps 61 and 63 that extend through strap mounting slots 66 and 68, respectively, formed in the plate 60. The slots 66 and 68 are preferably oriented perpendicular to a longitudinal extension of the first and second arms 31 and 33, respectively. The bands 61 and 63 are preferably looped or folded over and the superimposed ends of each band are secured to the base member 28 of the wrist strap 12, preferably through stitching, to thereby create loop portions that extend through the slots 66, 68. However, it will be understood that other means for attaching the lower mounting portion 46 to the base member 28 can be used, including but not limited to, adhesive bonding, clamping, mechanical fastening, and so on.

The lower plate 60 of the lower mounting portion 46 further includes a transverse slot 70 positioned generally between the threaded openings 56, 58 and extending transverse to the strap mounting slots 66, 68. The slot 70 is sized to receive a second extension member 75 (FIGS. 10 and 11) when the first extension member 26 is not used, as will be described in greater detail below. A lower step section 72 is formed in a forward end 73 of the plate 60 next to the transverse slot 70. A circular opening 74 extends through the lower step section 72 for receiving a cylindrically-shaped bearing connector 76. Preferably, the opening 74 is of a sufficient size to allow rotational movement of the bearing connector 76 when located therein. The bearing connector 76 in turn includes a transverse bore 78 for receiving a connecting shaft portion 80 of the first extension member 26. Retaining pins 82 and 84 extend through small, axially extending bores 86 and 88, respectively, formed in the bearing connector 76. The pins 82 and 84 engage a circumferential groove 90 formed in the connecting shaft portion 80 for retaining the connecting shaft portion within the transverse bore 78. In this manner, the first extension member 26, and thus the first bowstring release mechanism 14, can rotate about a central axis 92 of the connecting shaft portion for accommodating the preferences of different users. Likewise, the first extension member 26, and thus the first bowstring release mechanism 14, can rotate about a central axis 94 of the cylindrically-shaped bearing connector 76 to accommodate the preferences of different users as well as to move the release mechanism 14 between an in-use position, such as shown in FIG. 1, to either the first locked position (FIG. 2) or the second locked position (FIG. 3).

A first set of collinear locking grooves 96 (FIG. 8) is formed in the lower step section 72 and extends radially across the circular opening 74. Likewise, a second set of collinear locking groove grooves 98 is formed in the lower step section 72 next to the first set 96 and also extends radially across the circular opening 74. The set 96 is configured to receive the connecting shaft portion 80 of the first extension member 26 in the first locked position (FIG. 2). Likewise, the set 98 is configured to receive the connecting shaft portion 80 in the second locked position (FIG. 3). A biasing member 100, shown by way of example as a wavy flat spring, is located between an upper surface 102 of the bearing connector 76 and the lower surface 104 (FIGS. 7 and 9) of a circular pocket 106 formed in the lower surface 108 of an upper step section 110 of the upper mounting portion 48. The circular pocket 106 is sized to rotationally receive the bearing connector 76 so that the biasing member 100 is captured in the pocket 106 between the upper mounting portion 48 and the bearing connector 76. The biasing member 100 normally presses downwardly on the bearing connector 76 to thereby bias the connecting shaft portion 80 into one of the first and second sets of locking grooves. The depth of the locking grooves together with the diameter or cross-dimension of the connecting shaft portion 80 and the biasing force exerted by the biasing member 100 determines the force required by the user to remove the bowstring release mechanism 14 from the first and/or second locked positions. Although the sets of locking grooves are shown with similar depth and shape, it will be understood that the locking grooves of one set can have a different depth and/or shape than the locking grooves of the other set to vary the unlocking forces. Moreover, it will be understood that more or less locking grooves or sets of locking grooves can be provided to vary the amount of detent or locking positions without departing from the spirit and scope of the invention.

Figure 10:
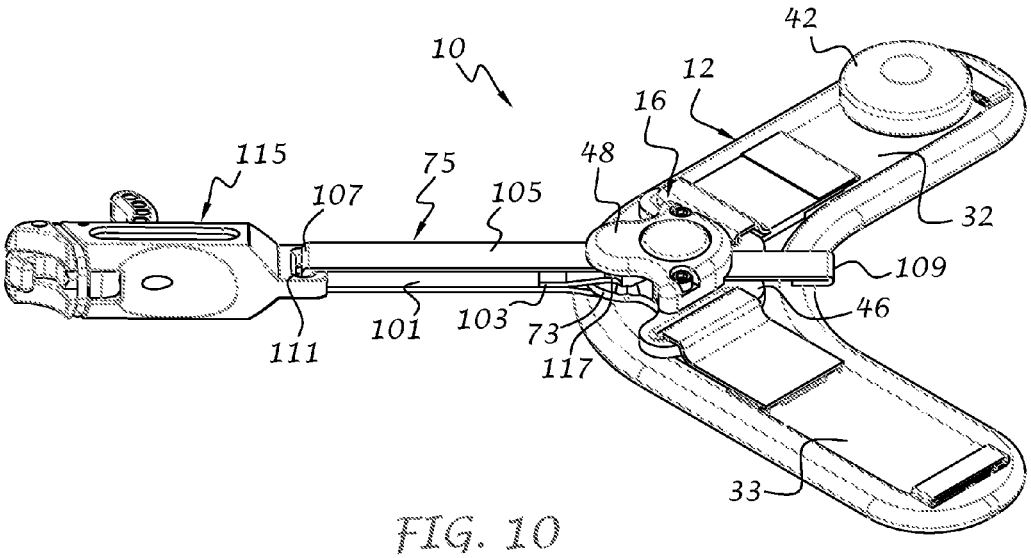
FIG. 10 is a perspective view of a bowstring release assembly including connection of a second bowstring release mechanism in accordance with the invention.
Figure 11:
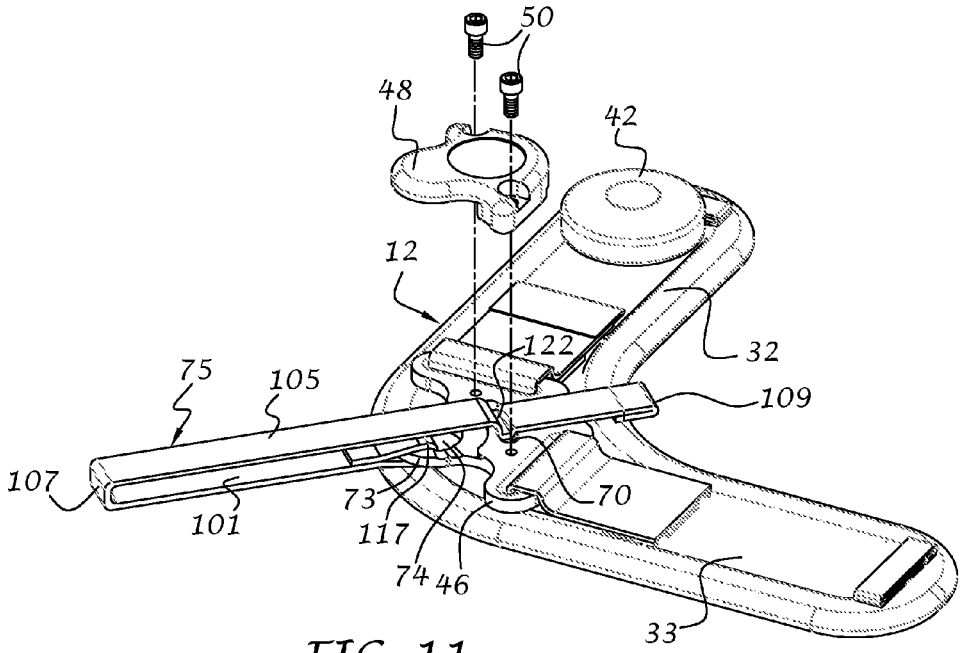
FIG. 11 is a partially exploded isometric view thereof.

As best shown in FIGS. 10 and 11, the second extension member 75 is preferably constructed of a single piece of flexible band material and includes a first leg 101 having a first end 103 connected to the lower mounting portion 46, a second leg 105 doubling back on the first leg 101, a loop 107 extending between the first and second legs, and a second end 109 of the second leg extending rearwardly of the upper and lower mounting portions. The loop 107 extends through a connection slot 111 of a second bowstring release mechanism 115 (FIG. 10). The first end 103 includes a loop 117 that extends through the opening 74 and secured to the first leg 101 through stitching or other well-known connecting means, such as clamping, adhesive bonding, and so on. In this manner, the first end 103 is secured to the lower mounting portion 46. The second end 109 can be doubled over and secured to the second leg 105 to reinforce the second end 109 and prevent it from slipping through the first and second mounting portions when connected therebetween.

Figure 9:
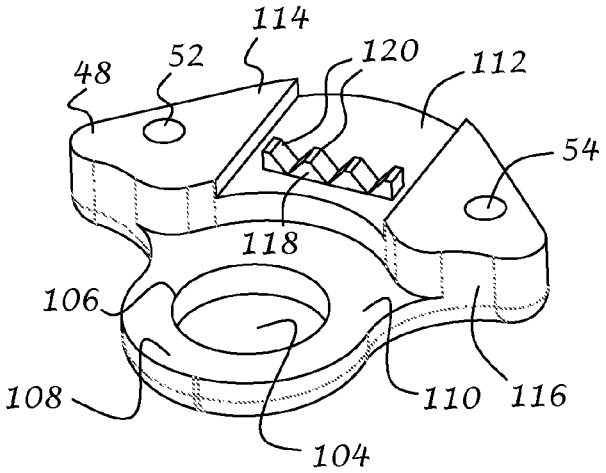
FIG. 9 is an isometric bottom view of the upper mounting portion in accordance with an exemplary embodiment of the invention.

Referring now to FIGS. 9-11, connection of the second extension member 75 to the wrist strap 12 will now be described. The upper mounting portion 48 includes a channel 112 formed in an upper surface 114 of a lower step section 116 for receiving the second extension member 75. A transverse projection 118 extends into the channel 112 and is received in the transverse slot 70 of the lower mounting portion 46 when the upper and lower mounting portions are connected together. A portion 122 of the second extension member 75, as partially shown in FIG. 11, is wedged in the transverse slot 70 by the transverse projection 118. The projection 118 can include teeth 120 for ensuring that the second extension member 75 will not slip out of the mounting assembly 16 during use. In order to adjust the length of the second extension member 75, or the distance between the wrist strap 12 and the second release mechanism 115, the second mounting portion 48 is loosened from the first mounting portion 46 and the second leg 105 is pulled forward or backward through the mounting assembly 16. When the proper length of the second extension member has been reached, the first and second mounting portions are secured together so that the second extension member is pinched in the transverse groove 70 by the transverse projection 118.

With the above-described arrangement, the lower mounting portion and upper mounting portion are capable of receiving rigid and flexible extension members to thereby accommodate a variety of extension members and their related bowstring release mechanisms.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, the wrist strap 12 can be of any style or type with a variety of different securing means. Moreover, it will be understood that the particular shape and features of the mounting assembly, the extension members, and the release mechanisms can vary depending on the types of connecting members to be connected thereto. It will be understood, therefore, that the present invention is not limited to the particular embodiments disclosed, but also covers modifications within the spirit and scope of the invention as defined by the appended claims.

What is claimed is:

1. A wrist strap for connection to a bowstring release mechanism via an extension member, the wrist strap comprising:

a flexible base member adapted to fit around the wrist of a user;

a mounting assembly connected to the base member;

an extension member having a connecting shaft portion extending from the mounting assembly and adapted for connection to the bowstring release mechanism, the mounting assembly being adapted to retain the extension member;

the mounting assembly including a lower mounting portion and an upper mounting portion connectable to the lower mounting portion, such that the connecting shaft portion is captured therebetween;

the lower mounting portion having a lower plate for connection to the wrist strap, an opening located in the lower plate, the opening having a central axis;

the connecting shaft portion being connected to the opening and extending radially therefrom for rotation about the central axis between a locked position and an unlocked position; and at least one groove associated with the lower plate, the at least one groove extending radially from the opening, the connecting shaft portion being adapted to drop into the at least one groove when the connecting shaft portion is rotated about the central axis for selectively retaining the connecting shaft portion against rotational movement about the central axis so that the bowstring release mechanism is clear of an archer's hand when not in use.

2. A wrist strap for connection to first and second bowstring release mechanisms via one of first and second extension members, the wrist strap comprising:

a flexible base member adapted to fit around the wrist of a user;

a mounting assembly connected to the flexible base member for selectively receiving and retaining the first extension member and the second extension member;

the first extension member comprising a connecting shaft portion with a first end thereof selectively connectable to the mounting assembly and a second end thereof connectable to the first bowstring release mechanism; and the second extension member comprising a flexible band with a first end thereof selectively connectable to the mounting assembly and a second end thereof selectively connectable the second bowstring release mechanism;

wherein the mounting assembly is connectable to the first and second extension members, and thus the first and second bowstring release mechanisms, without modification of the mounting assembly;

wherein the mounting assembly comprises an upper mounting portion connected to the lower mounting portion for capturing a selective one of the first and second extension members therebetween, the upper mounting portion and the lower mounting portion having cooperating features for capturing the plurality of different extension members, the cooperating features including a transverse slot in one of the upper and lower mounting portions for receiving the flexible band of the second extension member, and a transverse projection having transverse teeth in the other of the upper and lower mounting portions, with the transverse teeth extending into the transverse slot to thereby pinch the flexible band of the extension member therebetween.

3. A wrist strap according to claim 2, wherein the lower mounting portion further comprises:

a lower plate attached to the wrist strap;

an opening extending through the lower plate, the opening defining a central axis, the first extension member being rotatable about the central axis.

4. A wrist strap according to claim 3, wherein the opening is circular and the lower plate further comprises at least one groove extending radially from a center of the circle for engaging and releasably locking the connection shaft portion of the first extension member thereto.

5. A wrist strap according to claim 4, and further comprising a bearing connector mounted for rotation in the opening about the central axis, the bearing connector receiving and retaining the connection shaft portion of the first extension member for rotational movement therewith about the central axis.

6. A wrist strap according to claim 5, wherein the upper mounting portion has a circular pocket for rotationally receiving the bearing connector.

7. A wrist strap according to claim 2, wherein the upper mounting portion comprises the transverse teeth and the lower mounting portion comprises the transverse slot.

8. A wrist strap according to claim 6, and further comprising a biasing member positioned in the pocket between the upper mounting portion and the bearing connector for biasing the connection shaft portion in the at least one groove to thereby releasably lock the second extension member therein.

9. A mounting assembly for an archery wrist strap for retaining a bowstring release mechanism at a position that does not interfere with an archer's hand movement when the archery wrist strap is connected to an archer when not in use, the mounting assembly comprising:

a lower mounting member having a lower plate for connection to the wrist strap, a circular opening extending through the lower plate and defining a central axis, and at least one groove extending radially from the opening;

an upper mounting member connected to the lower mounting member, the upper mounting member having an upper plate with a circular pocket in coaxial alignment with the central axis of the circular opening of the lower plate;

an extension member having a connecting shaft portion for connection to the archery wrist strap and a distal end portion for connection to the bowstring release mechanism; and a bearing member rotatably mounted in the opening of the lower plate and the pocket of the upper plate, the bearing member comprising a transverse bore for receiving the connecting shaft portion of the extension member so that the connecting shaft portion rotates about the central axis to thereby rotate the bowstring release mechanism;

wherein the at least one groove releasably receives the connecting shaft portion as the connecting shaft portion rotates in alignment with the at least one groove and engages the groove to thereby releasably lock the connecting shaft portion within the groove, and thus the bowstring release mechanism when connected thereto, against rotational movement about the central axis so that the bowstring release mechanism does not interfere with an archer's hand movement when not in use.

10. A mounting assembly according to claim 9, and further comprising a biasing member positioned for biasing the connecting shaft towards the at least one groove.

11. A mounting assembly according to claim 10, wherein the at least one groove comprises at least two offset grooves for releasably locking the shaft portion in first and second locking positions.

* * * * *